United States Patent [19]

Tatum

[11] Patent Number: 4,487,214

[45] Date of Patent: Dec. 11, 1984

[54] DAMPER BLADE ACTUATING MECHANISM

[76] Inventor: James R. Tatum, 8 Kingsway Crescent, Toronto, Ontario, Canada, M8X 2R1

[21] Appl. No.: 303,477

[22] Filed: Sep. 18, 1981

[51] Int. Cl.[3] ..... E05F 15/20

[52] U.S. Cl. ..... 137/72; 16/48.5; 49/1; 98/121 A; 137/74; 137/601

[58] Field of Search ..... 49/1, 7; 98/1, 110, 98/121 A; 137/72, 74, 601; 16/48.5

[56] References Cited

U.S. PATENT DOCUMENTS 4,301,569 11/1981 McCabe ..... 49/1 X

*Primary Examiner*—Albert J. Makay
*Assistant Examiner*—Harold Joyce
*Attorney, Agent, or Firm*—George A. Rolston

[57] ABSTRACT

Damper blade actuator assembly for use in association with a damper having damper frame means adapted to be associated with an air duct system, and defining an air flow opening, and movable damper blade means operable for partially or completely obstructing such air flow, said actuator assembly comprising, a drive shaft adapted to be operatively coupled to suitable motor means for rotating said drive shaft in either direction, an operating arm swingably mounted adjacent said drive shaft and being rotatably movable relative to said drive shaft and connectible with said damper blade means, a coupling arm attached to said drive shaft for rotation therewith adjacent said operating arm, spring means connected between said operating arm and said coupling arm, said spring means urging said operating arm to move independently of said coupling arm in a direction tending to close said damper for emergency operation thereof while said coupling arm remains stationary, condition-sensitive retaining means connected between said operating arm and said coupling arm and opposing said spring means thereby normally restraining movement of said operating arm independently of said coupling arm, said retaining means being of sufficient strength to transmit forces from said coupling arm to said operating arm in response to rotation of said drive shaft in an opening direction to cause movement of said damper blade means, for controlled opening thereof, releasing of said retaining means releasing said operating arm to close the damper in an emergency, in response to said spring means, a drive tab on said coupling arm extending into releasable engagement with said operating arm to interconnect said coupling arm and said operating arm whereby the tab drives the operating arm upon rotation of said drive shaft in a closing direction for closing of said damper by said motor means for controlled operation, and, means for mounting said assembly adjacent said damper.

5 Claims, 9 Drawing Figures

DAMPER BLADE ACTUATING MECHANISM

The invention relates to dampers for use in air duct systems, for preventing flow of fire, smoke, and combustion gases therein and in particular, to automatic actuators for such dampers.

BACKGROUND OF THE INVENTION

Air duct systems, especially in commercial and institutional buildings, require dampers at various locations, to restrict flow of fire, smoke and combustion products in the event of a fire. Such dampers are required to operate automatically, in response to various conditions. In the majority of cases they will never be operated at all, since there will be no fire or smoke in the building. However, such dampers must be designed so that they will operate effectively, even after many years of inactivity, during which dust and the like may accumulate. In order to ensure that the dampers are in satisfactory working order, it is customary to test them from time to time. It is clearly desirable for such testing to be carried out from a remote location, without the need for opening up the air duct system at the location of each damper.

Numerous fire damper systems have been proposed in the past which have usually operated on the basis of a powerful spring, and a heat fusible metal link. The link was designed to melt at a certain temperature, thereby permitting the spring to activate the damper and close the duct.

In practice it is found that after a few years or many years of non-use, the blades or other components of the damper become so plugged with dust, etc. that they may, in some cases, have been rendered inoperative. Generally speaking, in these earlier devices. this condition could not be detected from outside the duct. The only way in which such earlier fire dampers could be checked was simply by opening up the duct and releasing the mechanism and cleaning them, and thereafter resetting them.

Even when these devices were in satisfactory working condition, they would operate satisfactorily only under certain restricted conditions, i.e. conditions of high heat. However, they were not sufficiently sensitive to operate effectively to limit the passage of smoke which had not yet reached a temperature high enough to destroy the fusible link. Thus, smoke from a fire in one location might well be transferred throughout a building, causing smoke damage and possible injury or endangering lives, without ever reaching a temperature sufficient to activate the fire dampers.

Clearly, it is desirable to provide a fire damper which is more sensitive, and can respond both to high temperature combustion products, and also to lower temperature smoke. In addition, it is desirable to provide such a fire damper which also permits the mechanism to be operated from a remote location, both in an emergency, and for testing purposes, and which provides visual proof that it is operating satisfactorily, without having to open up the ducts.

One form of damper which goes part way to meeting these objectives is shown in U.S. Letters Pat. No. 4,080,978. For various reasons, however, this is not completely satisfactory, and it is somewhat complex and expensive to manufacture.

One particular disadvantage of more complex fire damper designs is the fact that such fire dampers are, generally speaking, custom made for a particular building. The engineering of the air duct system, requiring different sizes of ducts at different locations, involves the manufacture of fire dampers designed to fit each particular size of duct as used in the building. In many cases in the past, the design of this type of more complex fire damper requiring two different functions, has been such that the assembly of the fire damper was carried out on site by relatively unskilled personnel. A variety of different levers, springs, locks and links were used in different locations on such fire dampers, to provide the multiple different functions. Such complexity has led to components being assembled in the wrong way, in some cases.

The design of the building air system may require that the fire damper be capable of being adjusted during normal operation to a partly closed position, which may be changed at different times, to balance air flows in the system. Preferably, this is achieved by power operated means, such as an electric motor.

It is, however, essential that this shall not interfere with the operation of the damper in an emergency.

It is desirable to provide an actuating mechanism for dampers which is factory built and combines all of the various different functions in one assembly, so that it may be simply attached to the fire damper frame at a predetermined location, thus ensuring that it will function effectively in the case of an emergency. An additional advantage achieved by the use of a separate actuator unit is the fact that it may be located on either side of the fire damper, either upstream or downstream, for maximum effectiveness.

Such actuators can also be combined with power operated means, permitting testing of the damper at intervals, and also permitting adjustment of the damper to balance air flows.

The use of such separately manufactured actuator assemblies also means that they can be mass produced in relatively large production runs, thereby reducing mistakes in assembly.

BRIEF SUMMARY OF THE INVENTION

With a view to providing these various advantages, the invention will be seen to comprise an actuator assembly for use in association with a damper having damper blade means operable for partially or completely obstructing air flow in a duct system, said actuator assembly comprising operating arm means adapted to be connected to such damper blade means for operating same, coupling arm means movably mounted adjacent said operating arm means, and being adapted to be connected to suitable motor means for power operation thereof, means biasing said operating arm means to move independently of said coupling arm means, retaining means connected between said operating arm means and said coupling arm means, and normally retaining said operating arm means against such movement independently of said coupling arm means, a drive tab means on said coupling arm means extending into releaseable engagement with said operating arm means whereby operation of said coupling arm means by said motor means will cause corresponding movement of said operating arm means in unison therewith, said retaining means being sensitive to a pre-determined condition to release said operating arm means for movement independently of said coupling arm means, and assembly mounting means adapted for attachment adjacent said damper blade means.

Any suitable form of smoke sensors will normally be provided in the duct work, or other areas in the air handling system, or in spaces which are served by the air handling system, and will usually be connected to the motor means for automatic operation. In addition, the air handling system will usually incorporate a main control panel, with manual controls whereby motor means for individual such fire dampers may be manually operated for testing or balancing purposes. Suitable indicators such as lights, will also typically be incorporated, so as to give a visual indication of satisfactory operation of each of the dampers.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
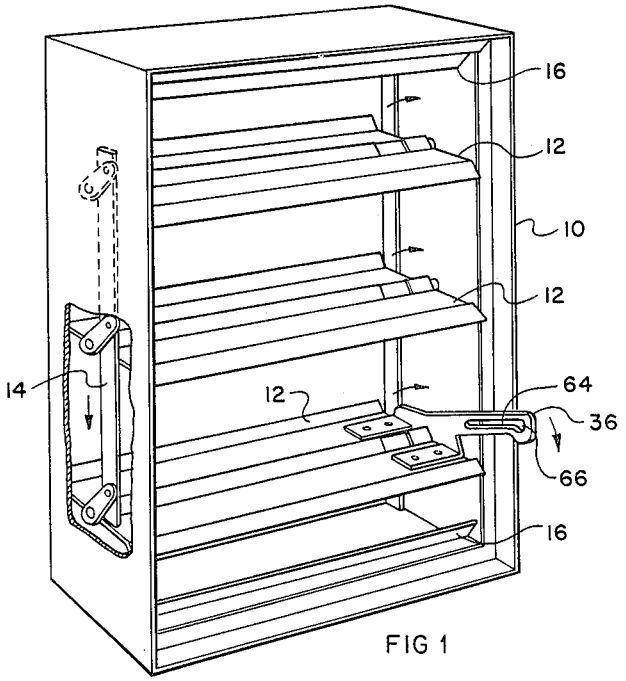
FIG. 1 is a perspective illustration showing a fire damper, and actuator located thereon in accordance with the invention.

As shown in FIG. 1, a fire damper of the type to which the invention applies, typically comprises a frame 10 having two sides and a top and bottom, usually although not necessarily, formed of a continuous length of roll formed sheet metal, formed with three bends forming three of the corners, and joined at the fourth corner.

One or more damper blades indicated generally as 12, are rotatably mounted between the opposite sides of the frame 10, and are rotatable between open and closed positions. Where more than one such damper blade 12 is provided, then an operating linkage 14 interconnects the blades, at one end, usually being located within a portion of the frame 10, and linking all of the blades 12 together so that they rotate between open and closed positions in unison.

Usually, blade stops 16 are provided at the upper and lower ends of the frame, for halting rotation of the blades in their closed position. In addition, any suitable form of blade locking mechanism may be provided in association with one of the blades 12, and one of the blade stops 16.

The details of these components may vary from one design of damper to another, and are described here merely by way of illustration, for the purpose of explaining the principles of the invention.

As explained above, the fire dampers of this type are incorporated in air ducts in air handling systems usually in larger commercial, institutional or office buildings, at various locations. They are required to be manufactured in a variety of different sizes to suit the size of the particular duct and location in the building.

Since they are designed only for use in emergency, in the great majority of cases they are never operated. They are required, therefore, to withstand many years of inactivity, and must still function effectively in an emergency to shut off the duct, so as to prevent spread of fire, smoke or combustion products through the duct work.

In accordance with the invention, an actuator assembly for the damper blades 12 is indicated generally as 20, and is shown in more detail in FIGS. 2 to 6.

It will be seen to comprise an actuator frame 22, having spaced apart mounting flanges 24, through which is rotatably mounted a drive shaft 26. The drive shaft 26 is adapted so that it may be coupled to any suitable form of power operated rotating means, indicated schematically as 27, such as an electrical or pneumatic motor, of a type well known in the art. The motor 27 will be located outside the air duct and will be connected to any suitable control means, which may include both manual control means for testing the operation of the damper, and which may also include automatic smoke responsive control means, responsive to the presence of smoke either in the duct work itself or in any areas of the building. Such control means may therefore incorporate typical smoke detectors capable of detecting the presence of smoke well before it reaches critical temperatures or concentrations. As explained, a typical building air handling system will incorporate a central control panel (not shown) where such controls may be located or connected, and which may incorporate suitable indicators, such as lights or the like, which are operative to indicate satisfactory operation of any one of the individual fire dampers in the system.

The details of such control panels, lights, smoke detectors and the like are omitted for the sake of clarity.

Figure 2:
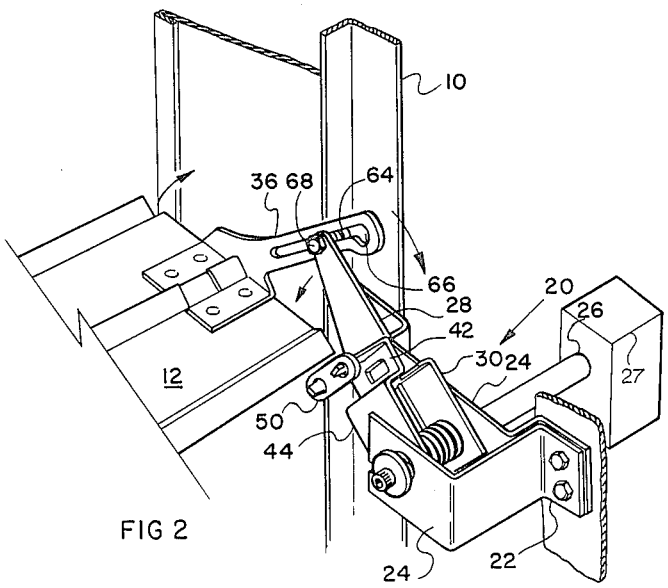
FIG. 2 is a greatly enlarged perspective illustration of the actuator of FIG. 1.
Figures 3, 4:
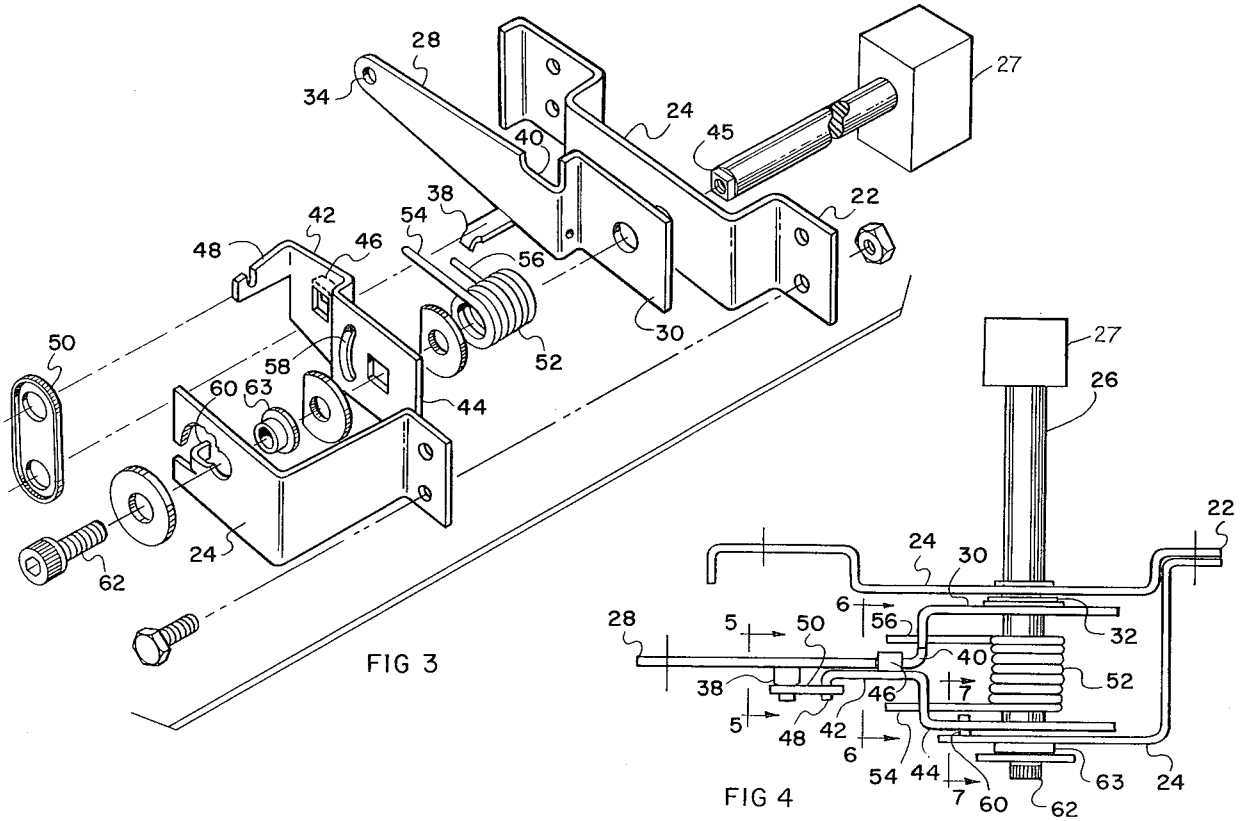
FIG. 3 is an exploded view of the actuator of FIG. 2.
FIG. 4 is a top plan view of the actuator of FIG. 2.
Figure 5:
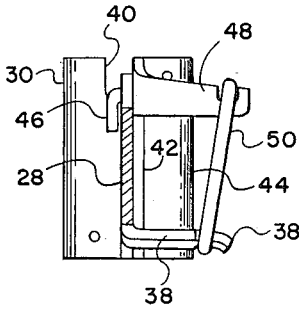
FIG. 5 is a section along 5—5 of FIG. 4.
Figure 6:
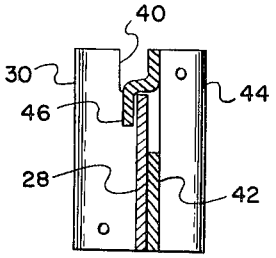
FIG. 6 is a section along 6—6 of FIG. 4.
Figure 7:
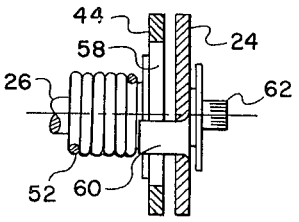
FIG. 7 is a section along 7—7 of FIG. 4.

The actuating assembly of FIG. 2 further comprises an operating arm means 28 having an offset plate portion 30. A bronze bushing 32 (FIG. 4) is fastened on plate portion 30 and is freely rotatable on shaft 26. Arm means 28 has a free end provided with a connecting hole 34, by means of which it may be operatively coupled to an operating lever 36 fastened to one of the damper blades 12. An attachment tongue 38 is formed on arm 28, for reception of one end of a fusible link, in a manner to be described below. A notch 40 is formed in arm 28, the use of which is described below.

In order to move operating arm 28, in the motor operated mode of operation, a coupling arm means 42 is provided. Arm means 42 has an offset plate portion 44, which is keyed to the square end 45 of shaft 26 in any suitable means, so that it rotates with shaft 26 in unison. Arm 42, and arm 28 are so dimensioned that they lie closely adjacent to one another, with their offset portions 30 and 44 spaced apart from one another along shaft 26 as shown.

A connecting or drive tab 46 extends from one side of arm 42, into the open sided notch 40 on arm 28. Tab 46 is not fastened to arm 28, and simply bears against it, so that upon rotation of arm 42 in a direction tending to close damper blades 12, tab 46 will force arm 28 to move in the same direction.

An attachment tongue 48 is also provided on arm 42, and extends to one side thereof in the same manner as tongue 38 on arm 28. A condition-sensitive retaining means such as fusible metal link 50 may be connected with both tongues 38 and 48. Link 50 is made of a suitable metal designed to melt at a predetermined temperature, so as to produce operation of arm 28 in a second mode. Other forms of retaining means sensitive to some changing condition may be equally applicable.

A spring 52 is carried on shaft 26, and is provided with two end portions 54 and 56. End portion 54 is attached to coupling arm 42, and end portion 56 is attached to operating arm 28. With arms 42 and 28 along side one another, and the fusible link 50 in place as shown, spring 52 is rotatably stressed, and arms 42 and 28 are restrained from rotation relative to one another in response to the spring only by the presence of the fusible link 50.

Plate portion 44 of arm 42 is provided with an arcuate slotted recess 58, and a stop member 60 is formed on one of flanges 24, so as to define limits of rotation of arm 42, and shaft 26 which is fastened to it. The entire assembly may be held together in any suitable manner such as, for example, by means of bolt 62 fitting in the end of shaft 26, and supported by bronze bushing 63.

While a variety of different blade locking means may be provided, it is particularly convenient to provide operating lever 36 with an elongated slotted opening 64, terminating in an offset locking recess 66. A suitable coupling pin 68 is located in hole 34, and rides in slot 64.

When installed, the damper frame 10 is usually part of the actual walls of the duct (not shown), and the actuating assembly 20 of the invention is attached usually to the damper frame or possibly to the inside of the duct work, by means of mounting frame 22. The shaft 26 extends through the duct wall, and any suitable operating motor 27 is attached to the exterior of the duct wall, or within the building in any suitable manner and is operatively coupled to shaft 26 so as to rotate same in either direction. The motor 27 may also carry the various control connections, and sensing connections as necessary, depending upon the particular design of the system.

In operation, in normal use, the actuator assembly will be in the position shown in FIG. 2, with the arms 42 and 28 located along side one another, and held together by engagement of the link 50. The link 50 is prevented from actually falling off the tongues 48 and 38, by the tension of the spring 52.

In this position of the actuating assembly, the damper blades 12 will be in their open position, as shown in FIG. 1, so that air can pass freely along the duct.

Figure 8:
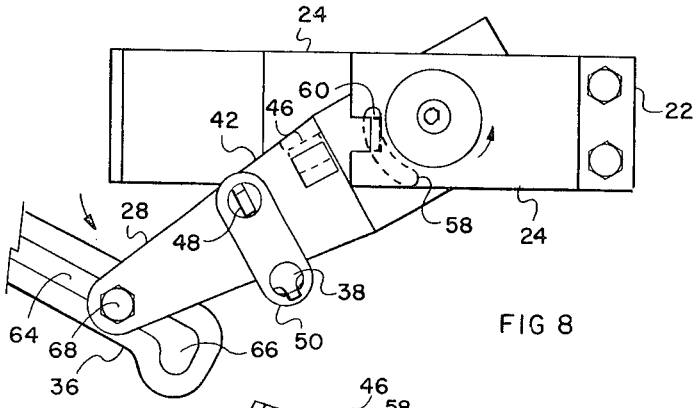
FIG. 8 is a side elevational view of the actuator of FIG. 2 showing one mode of operation, and, FIG. 9 is a side elevational view of the actuator of FIG. 2 showing another mode of operation.
Figure 9:
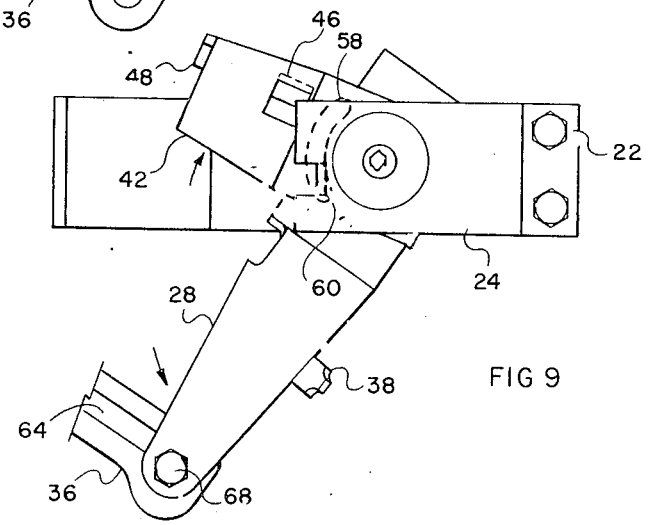

As noted above, emergencies can take two forms, namely a low temperature smoke condition, and a higher temperature condition indicating the presence of combustion products. Low temperature smoke will not affect the fusible link 50 which will therefore remain intact. It will, however, be detected by suitable smoke detectors (not shown) located anywhere in the building or the duct work, and suitable signals will be sent to a central control panel, or may be arranged to provide for automatic operation of individual dampers. In any event, as a result of such smoke being detected, it is assumed that a signal is sent to the motor 27 on the exterior of the duct work, which is connected to shaft 26. The motor 27 will thus rotate shaft 26 in an anti-clockwise direction, and produce the form of operation illustrated in FIG. 8. In this mode of operation rotation of shaft 26 will in turn cause rotation of coupling arm 42 in an anti-clockwise direction. Engagement tab 46 of arm 42 will then bear on arm 28, and cause arm 28 to rotate in the same direction as arm 42 in unison therewith. It is noted that since spring 52 is connected by its ends 54 and 56 only to respective arms 42 and 28, then rotation of arms 42 and 28 together in unison will thus also cause spring 52 to rotate together with them as a single unit.

As arm 28 is rotated anti-clockwise, the stud 68 riding in slot 64 will cause lever 36 to swing downwardly, thereby closing all of damper blades 12.

The limiting action of stop member 60 in slot 58 will define the rotational limits of travel of shaft 26 and arms 42 and 28 in this mode of operation. By this means, the stud 68 is prevented from dropping down into locking recess 66.

Once the emergency condition has been corrected, the building staff can simply operate the motors of the various dampers in a reverse direction and open them up so as to allow normal air circulation once more.

Similarly, the building staff may operate the motors periodically, so as to test operation of the dampers, and ensure that they are free to move. All of these functions can be carried out without having to open up the duct work, and release or reset dampers.

Clearly, if desired, the damper blade can be adjusted to a partly closed position, to balance air flows during normal operation, by operating the motor in the same way.

The second emergency condition assumes that higher temperature combustion products are moving in the duct. Normally, such higher temperature combustion products will already have produced smoke which will have activated the motors, and caused the dampers to close. It is, however, possible that smoke detectors may fail, motors may fail, electrical or other supplies may fail, or the fire itself may have caused so much damage that the control system for the various dampers no longer operates. In this case, the higher temperature combustion products will melt the fusible link 50, so that arm 28 is free to move independently of arm 42. The tension in spring 52 will thus cause a reaction between arms 42 and 28. Arm 42, being keyed to shaft 26, which is stationary, will thus remain stationary. Arm 28, being free to move on shaft 26, will thus swing downwardly, again swinging lever 36 downwardly and closing the damper blades 12. In this mode of operation, however, movement of arm 28 is not restrained by locking member 60, so that stud 68 will move along the full extent of slot 64, and enter the locking recess 66. Once this has occurred, the damper blades 12 will remain closed until the building staff opens up the duct work, and manually reset the actuating mechanism, and replace the fusible link 50.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. Damper blade actuator assembly for use in association with a damper having damper frame means adapted to be associated with an air duct system, and defining an air flow opening, and movable damper blade means operable for partially or completely obstructing such air flow, said actuator assembly comprising;

a drive shaft adapted to be operatively coupled to suitable motor means for rotating said drive shaft in either direction;

an operating arm swingably mounted adjacent said drive shaft and being rotatably movable relative to said drive shaft and connectible with said damper blade means;

a coupling arm attached to said drive shaft for rotation therewith adjacent said operating arm;

spring means connected between said operating arm and said coupling arm, said spring means urging said operating arm to move independently of said coupling arm in a direction tending to close said damper for emergency operation thereof while said coupling arm remains stationary;

condition-sensitive retaining means connected between said operating arm and said coupling arm and opposing said spring means thereby normally restraining movement of said operating arm independently of said coupling arm, said retaining means being of sufficient strength to transmit forces from said coupling arm to said operating arm in response to rotation of said drive shaft in an opening direction to cause movement of said damper blade means, for controlled opening thereof;

releasing of said retaining means releasing said operating arm to close the damper in an emergency, in response to said spring means;

a drive tab on said coupling arm extending into releasable engagement with said operating arm to interconnect said coupling arm and said operating arm whereby the tab drives the operating arm upon rotation of said drive shaft in a closing direction for closing of said damper by said motor means for controlled operation, and, means for mounting said assembly adjacent said damper.

2. Damper blade actuator assembly as claimed in claim 1 including bracket means rotatably supporting said drive shaft, and having attachment means for attaching same adjacent said damper frame means.

3. Damper blade actuator assembly as claimed in claim 1 including limit means interengageable with said coupling arm, for limiting the arc of rotation thereof.

4. Damper blade actuator assembly as claimed in claim 1 wherein said drive tab is formed on said coupling arm, and extends to one side thereof into overlying engagement with said operating arm, and being releasable from said operating arm, upon releasing of said condition-sensitive retaining means.

5. Damper blade actuator assembly as claimed in claim 1 wherein said spring means comprises a helical coil spring, loosely fitting around said drive shaft, and including spring arm means extending from opposite ends thereof, into engagement with said operating arm and said coupling arm.

* * * * *